US011205393B2

(12) United States Patent
Kang

(10) Patent No.: US 11,205,393 B2
(45) Date of Patent: Dec. 21, 2021

(54) DISPLAY DEVICE AND DRIVING METHOD THEREFOR

(71) Applicants: HKC CORPORATION LIMITED, Shenzhen (CN); CHONGQING HKC OPTOELECTRONICS TECHNOLOGY CO., LTD., Chongqing (CN)

(72) Inventor: Chih Tsung Kang, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/043,093

(22) PCT Filed: Nov. 14, 2018

(86) PCT No.: PCT/CN2018/115291
§ 371 (c)(1),
(2) Date: Sep. 29, 2020

(87) PCT Pub. No.: WO2020/056893
PCT Pub. Date: Mar. 26, 2020

(65) Prior Publication Data

US 2021/0027723 A1 Jan. 28, 2021

(30) Foreign Application Priority Data

Sep. 18, 2018 (CN) ..... 201811088563.5

(51) Int. Cl.
*G09G 3/34* (2006.01)

(52) U.S. Cl.
CPC ..... *G09G 3/3413* (2013.01); *G09G 3/3426* (2013.01); *G09G 2320/0233* (2013.01); (Continued)

(58) Field of Classification Search
CPC ..... G09G 3/3406–3426; G09G 2320/0233; G09G 2320/0247; G09G 2320/0646; G09G 2360/16
See application file for complete search history.

(56) References Cited

U.S. PATENT DOCUMENTS

2006/0232545 A1 10/2006 Sekiguchi
2017/0061901 A1 3/2017 Zhang et al.
2019/0019464 A1* 1/2019 Xing ..... G09G 3/2022

FOREIGN PATENT DOCUMENTS

CN 1971696 A 5/2007
CN 101281730 A 10/2008
(Continued)

OTHER PUBLICATIONS

International Search Report from International Application No. PCT/CN2018/115291 dated Jun. 24, 2019.

*Primary Examiner* — Gene W Lee
(74) *Attorney, Agent, or Firm* — Marcus S. Simon

(57) ABSTRACT

A display device, wherein a drive circuit thereof is used to display each frame of image by means of two sub-frames; and determining, according to an average drive voltage of sub-pixels of all colors, the magnitudes of backlight compensation signals respectively corresponding to the two sub-frames so as to adjust the light emission brightness of a light source.

16 Claims, 4 Drawing Sheets

(52) U.S. Cl.
CPC ..... *G09G 2320/0247* (2013.01); *G09G 2320/0646* (2013.01); *G09G 2360/16* (2013.01)

(56) References Cited

FOREIGN PATENT DOCUMENTS

| | | | |
|---|---|---|---|
| CN | 103514839 | A | 1/2014 |
| CN | 104267541 | A | 1/2015 |
| CN | 106782375 | A | 5/2017 |
| CN | 106782377 | A | 5/2017 |
| CN | 107978282 | A | 5/2018 |
| CN | 108122544 | A | 6/2018 |
| JP | H1173898 | A | 3/1999 |
| JP | 200413120 | A | 1/2004 |

* cited by examiner

200

| | | | | | | |
|---|---|---|---|---|---|---|
| | | | | | | |
| | | | | | | |
| | | | | | | |
| | | f(x−1, y−1) | f(x, y−1) | f(x+1, y−1) | | |
| | | f(x−1, y) | f(x, y) | f(x+1, y) | | |
| | | f(x−1, y+1) | f(x, y+1) | f(x+1, y+1) | | |
| | | | | | | |
| | | | | | | |
| | | | | | | |

DISPLAY DEVICE AND DRIVING METHOD THEREFOR

TECHNICAL FIELD

This application relates to the field of display, and more particularly, to a display device and a driving method therefor.

BACKGROUND

Exemplarily, most large-dimension display devices adopt negative vertical alignment (VA) liquid crystal or in-plane switching (IPS) liquid crystal technology. The brightness of VA type liquid crystal drive saturates rapidly along with driving voltage in a large view angle, resulting in relatively serious color cast of the view angle, and further affecting the image quality.

An improvement scheme is that each frame of the image is displayed by a front sub-frame and a rear-sub-frame (for example, a 60 Hz image is displayed by a front 120 Hz sub-frame and a rear 120 Hz sub-frame), the pixel driving voltage of one sub-frame is high voltage, and the pixel driving voltage of the other sub-frame is low voltage (high and low only represent relative difference of the pixel driving voltages of the two sub-frames).

However, according to the scheme, when the difference between the high voltage and the low voltage is great, human eyes can obviously feel flicker caused by brightness difference of the two sub-frames.

SUMMARY

According to various embodiments of this application, a display device and a driving method therefor are provided.

A driving method for a display device, including: dividing a red-green-blue three-color backlight source of a display device into a plurality of regions, pixels of the display device are divided into blocks in one-to-one correspondence to the regions of the backlight source; independently controlling the emergent light brightness of a light source of each color in each region with a regional control unit; acquiring an input signal of each frame of image to be displayed, and a high voltage signal and a low voltage signal of a driving voltage of each sub-pixel of the display device; displaying each frame of image by a front sub-frame and a rear sub-frame according to the high voltage signal and the low voltage signal, driving voltages of two adjacent sub-pixels in each of the blocks for each sub-frame are respectively a high voltage and a low voltage, and the driving voltages of each sub-pixel in the two sub-frames are respectively a high voltage and a low voltage; determining the amplitude of backlight brightness compensation signals of the light source of each color in each of the regions respectively corresponding to two sub-frames according to the average driving voltage of the sub-pixel of each color in each of the regions, wherein the higher the average driving voltage is, the weaker the backlight brightness compensation signal is, and the lower the average driving voltage is, the stronger the backlight brightness compensation signal is, so as to alleviate the brightness difference of each of the regions in the two sub-frames; and adjusting the emergent light brightness of the light source of each color in each region according to the backlight brightness compensation signal.

A display device, including: a display panel; a backlight circuit, including a backlight source and a regional control unit; the backlight source is a red-green-blue three-color backlight source, the regional control unit divides the backlight source into a plurality of regions; each region includes three light sources including a red light source, a green light source, and a blue light source; the regional control unit is further configured to independently control the emergent light brightness of each light source in each region, and pixels of the display panel are divided into blocks in one-to-one correspondence to the regions of the backlight circuit; and a driving circuit, including an input circuit, configured to acquire an input signal of each frame of image to be displayed, and acquire a high voltage signal and a low voltage signal of a driving voltage of each sub-pixel of the display device; a framing display circuit, configured to display each frame of image by a front sub-frame and a rear sub-frame according to the high voltage signal and the low voltage signal, wherein the driving voltages of each sub-frame to two adjacent sub-pixels in each of the blocks are respectively a high voltage and a low voltage, and the driving voltages of each sub-pixel in the two sub-frames are respectively a high voltage and a low voltage; a backlight compensation determination circuit, configured to determine the amplitude of backlight brightness compensation signals of the light source of each color in each of the regions respectively corresponding to the two sub-frames according to the average driving voltage of the sub-pixel of each color in each of the regions, wherein the higher the average driving voltage is, the weaker the backlight brightness compensation signal is, and the lower the average driving voltage is, the stronger the backlight brightness compensation signal is, so as to alleviate the brightness difference of each of the regions between the two sub-frames; and a backlight brightness adjustment circuit, configured to adjust the emergent light brightness of the light source of each color in each region according to the backlight brightness compensation signal.

A display device, wherein the display device is a liquid crystal display, including:

a display panel;

a backlight circuit, including a backlight source and a regional control unit, the backlight source is a red-green-blue three-color backlight source, the regional control unit is configured to divide the backlight source into a plurality of regions; each of the regions includes three light sources, including a red light source, a green light source, and a blue light source; the regional control unit is further configured to independently control the emergent light brightness of each region, and the pixels in the display panel are divided into blocks in one-to-one correspondence to the regions of the backlight circuit; and a driving circuit, including:

an input circuit, configured to acquire the input signal of each frame of image to be displayed, and acquire the high voltage signal and the low voltage signal of the driving voltage of each sub-pixel of the display device;

a framing display circuit, configured to display each frame of image by a front sub-frame and a rear sub-frame according to the high voltage signal and the low voltage signal, wherein the driving voltages of each sub-frame to two adjacent sub-pixels in each of the blocks are respectively a high voltage and a low voltage, and the driving voltages of each sub-pixel in the two sub-frames are respectively a high voltage and a low voltage;

a reference backlight brightness circuit, configured to acquire a reference backlight brightness signal corresponding to each frame of image;

a backlight compensation determination circuit, configured to count on the driving voltage average value of the sub-pixels of all target colors in each of the regions in one sub-frame, the driving voltage average value in the other sub-frame, the driving voltage average value of the high voltage signal and the driving voltage average value of the low voltage signal, and calculate the amplitude of the backlight brightness compensation signal of the light source of each color in each of the regions respectively corresponding to the two sub-frames according to the following formulae:

for a red sub-pixel:

$$A_{M_R}*R_{M_ave_H}+A_{M_R}*R_{M_ave_L}=A_{M_R1}*R_{M_ave1}+A_{M_R2}*R_{M_ave2};$$

$$A_{M_R1}*R_{M_ave1}=A_{M_R2}*R_{M_ave2};$$

wherein M represents a serial number of the region, $A_{M_R}$ represents the brightness value of the reference backlight brightness signal of the red light source, $A_{M_R1}$ represents the brightness value of the backlight brightness compensation signal of the red light source of the first sub-frame in two corresponding sub-frames in the region M, $A_{M_R2}$ represents the brightness value of the backlight brightness compensation signal of the red light source of the second sub-frame in the two corresponding sub-frames in the region M, $R_{M_ave1}$ represents the average value of the driving voltage of the red sub-pixel of the first sub-frame in the region M, $R_{M_ave2}$ represents the average value of the driving voltage of the red sub-pixel of the second sub-frame in the region M, $R_{M_ave_H}$ represents the average value of the driving voltage of the red sub-pixel of the sub-frame corresponding to the high voltage signal in the region M, and $R_{M_ave_L}$ represents the average value of the driving voltage of the red sub-pixel of the sub-frame corresponding to the low voltage signal in the region M;

for a green sub-pixel:

$$A_{M_G}*G_{M_ave_H}+A_{M_G}*G_{M_ave_L}=A_{M_G1}*G_{M_ave1}+A_{M_G2}*G_{M_ave2};$$

$$A_{M_G1}*G_{M_ave1}=A_{M_G2}*G_{M_ave2};$$

wherein M represents a serial number of the region, $A_{M_G}$ represents the brightness value of the reference backlight brightness signal of the green light source, $A_{M_G1}$ represents the brightness value of the backlight brightness compensation signal of the green light source of the first sub-frame in two corresponding sub-frames in the region M, $A_{M_G2}$ represents the brightness value of the backlight brightness compensation signal of the green light source of the second sub-frame in the two corresponding sub-frames in the region M, $G_{M_ave1}$ represents the average value of the driving voltage of the green sub-pixel of the first sub-frame in the region M, $G_{M_ave2}$ represents the average value of the driving voltage of the green sub-pixel of the second sub-frame in the region M, $G_{M_ave_H}$ represents the average value of the driving voltage of the green sub-pixel of the sub-frame corresponding to the high voltage signal in the region M, and $G_{M_ave_L}$ represents the average value of the driving voltage of the green sub-pixel of the sub-frame corresponding to the low voltage signal in the region M; and for a blue sub-pixel:

$$A_{M_B}*B_{M_ave_H}+A_{M_B}*B_{M_ave_L}=A_{M_B1}*B_{M_ave1}+A_{M_B2}*B_{M_ave2};$$

$$A_{M_B1}*B_{M_ave1}=A_{M_B2}*B_{M_ave2};$$

wherein M represents a serial number of the region, $A_{M_B}$ represents the brightness value of the reference backlight brightness signal of the blue light source, $A_{M_B1}$ represents the brightness value of the backlight brightness compensation signal of the blue light source of the first sub-frame in two corresponding sub-frames in the region M, $A_{M_B2}$ represents the brightness value of the backlight brightness compensation signal of the blue light source of the second sub-frame in the two corresponding sub-frames in the region M, $B_{M_ave1}$ represents the average value of the driving voltage of the blue sub-pixel of the first sub-frame in the region M, $B_{M_ave2}$ represents the average value of the driving voltage of the blue sub-pixel of the second sub-frame in the region M, $B_{M_ave_H}$ represents the average value of the driving voltage of the blue sub-pixel of the sub-frame corresponding to the high voltage signal in the region M, and $B_{M_ave_L}$ represents the average value of the driving voltage of the blue sub-pixel of the sub-frame corresponding to the low voltage signal in the region M; and a backlight brightness adjustment circuit, configured to adjust the emergent light brightness of the light source of each color in each region according to the backlight brightness compensation signal.

According to the display device and the driving method therefor, each frame of image is displayed by a front sub-frame and a rear sub-frame and is driven by adopting high and low voltage signals alternately, furthermore, high and low driving voltages of a first frame of image and a second frame of image are reversed, and a backlight brightness adjustment signal of the next picture is generated according to the average driving voltage of sub-pixels of a target color in each region, so as to alleviate brightness difference of a same pixel in two sub-frames, and further reduce the flickering phenomenon caused by fluctuation of the driving voltages of the two sub-frames. The regional control unit divides the backlight circuit into a plurality of regions capable of independently controlling emergent light brightness, and correspondingly can perform independent backlight brightness compensation on pixels of different blocks on the display panel, and thus has a better anti-flickering effect in comparison with a backlight circuit adopting a uniform backlight brightness. Furthermore, by adopting the driving method for a display device, the pixel of the liquid crystal display does not need to be divided into main sub-pixel and secondary sub-pixel, and therefore, the process complexity of the display panel is greatly reduced, the penetration rate and the resolution of the liquid crystal display panel are greatly promoted, and the cost of backlight design is reduced.

DETAILED DESCRIPTION OF THE EMBODIMENTS

To help understand this application, this application will be fully described with reference to the accompanying drawings. The accompanying drawings illustrate embodiments of this application. However, this application can be implemented in various different forms, and is not limited to the embodiments described herein. On the contrary, the embodiments are described for the purpose of providing a more thorough and comprehensive understanding of the contents disclosed by this application.

It should be noted that when an element is referred to as being "fixed" or "fastened" to another element, it can be directly fixed or fastened to the other element or intervening elements may also be present. When an element is referred to as being "coupled" or "connected" to another element, it can be directly coupled or connected to the other element or intervening elements may also be present. As used herein, the terms, such as "vertical", "horizontal", "under", "upper", "lower", "left", "right", and the like, are used for the purpose of description only.

Display devices to which the driving method for a display device disclosed by this application is applicable may be liquid crystal displays of TN (twisted nematic), VA (vertical alignment), OCB (optical compensated bend) and other types, but it is not limited thereto. Downright or broadside backlight may be applied as backlight of the liquid crystal display, and the backlight source is an RGB (red-green-blue) three-color backlight source. The driving method is also applicable to the situation that the liquid crystal display is a curved screen.

Figure 2:
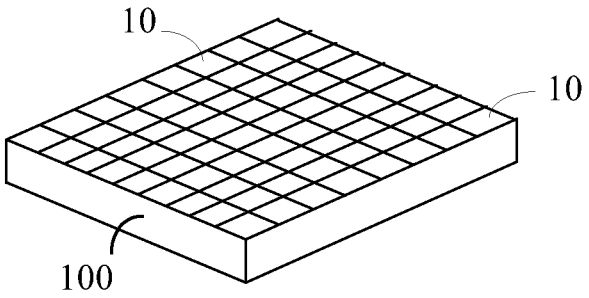
FIG. 2 is a schematic diagram of a backlight circuit of a liquid crystal display applicable to the driving method for a display device in an embodiment.

FIG. 2 is a schematic diagram of a backlight circuit of a display device in an embodiment, and the backlight circuit 100 includes a backlight source and a regional control unit, light of the backlight source enables the backlight circuit 100 to present a plurality of regions 10 (in this embodiment, the quantity is 9*8=72) in matrix arrangement under the control of the regional control unit, the emergent light brightness of the light source of each color is independently controlled by the regional control unit in each region 10, and emergent light enters the human eyes after passing through the display panel of the liquid crystal display. The display panel is divided into blocks according to the condition that which pixels on the display panel will be irradiated by the emergent light of each region 10, and the blocks are in one-to-one correspondence to the regions 10 of the backlight circuit. For example, in the embodiment shown in FIG. 2, the display panel is divided into 72 blocks.

Figure 1:
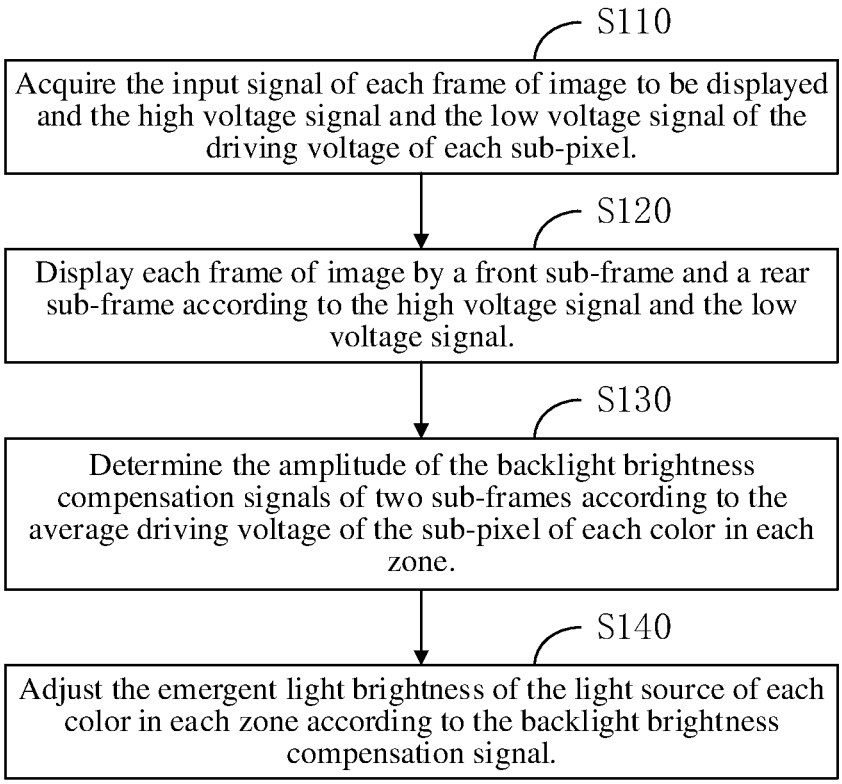
FIG. 1 is a flowchart of a driving method for a display device in an embodiment.

FIG. 1 is a flowchart of a driving method for a display device in an embodiment, including the following steps.

S110, acquire an input signal of each frame of image to be displayed and a high voltage signal and a low voltage signal of a driving voltage of each sub-pixel.

The liquid crystal display acquires the input signal of each frame of image to be displayed from external device-for example, a graphics processing unit (GPU). The liquid crystal display also may obtain a reference backlight brightness (which is used for controlling the emergent light brightness of the backlight source, and can be expressed by a reference backlight brightness signal) according to the input signal, and the brightness is the backlight brightness of the backlight source when backlight compensation is not performed. As described in the background, according to an exemplary technology, each frame of image is displayed by a front sub-frame and a rear sub-frame, that is, a frame of image is segmented into two frames of images in time sequence, which are respectively marked as a first frame and a second frame, and an image corresponding to the input signal is displayed to a user by the mutual compensation of the first frame and the second frame. The driving voltage of each pixel on the first frame is greater than the driving voltage of the corresponding sub-pixel on the second frame. That is, the first frame is driven by adopting a high driving voltage, while the second frame is driven by adopting a low driving voltage lower than that of the first frame. The driving voltage of each sub-pixel of the first frame and the second frame may be sought and obtained via a Look Up Table (LUT). Specifically, the LUT will be stored in a frame buffer in advance in the liquid crystal display. The LUT is a corresponding relation table of the voltage of the input signal and driving voltage of each sub-pixel of the first frame and the second frame corresponding to the input signal. Taking a 8 bit driving voltage signal as an example, the color gray value 0-255 of each R/G/B input signal corresponds to 256 pairs of high and low voltage signals, totally 3*256 pairs of high voltage signals $R_{TH}/G_{TH}/B_{TH}$ and low voltage signals $R_{TL}/G_{TL}/B_{TL}$. Therefore, the high voltage signal and the low voltage signal of the corresponding driving voltage may be sought according to the color gray value of each sub-pixel in the input signal.

S120, display each frame of image by a front sub-frame and a rear sub-frame according to the high voltage signal and the low voltage signal.

Figure 3:
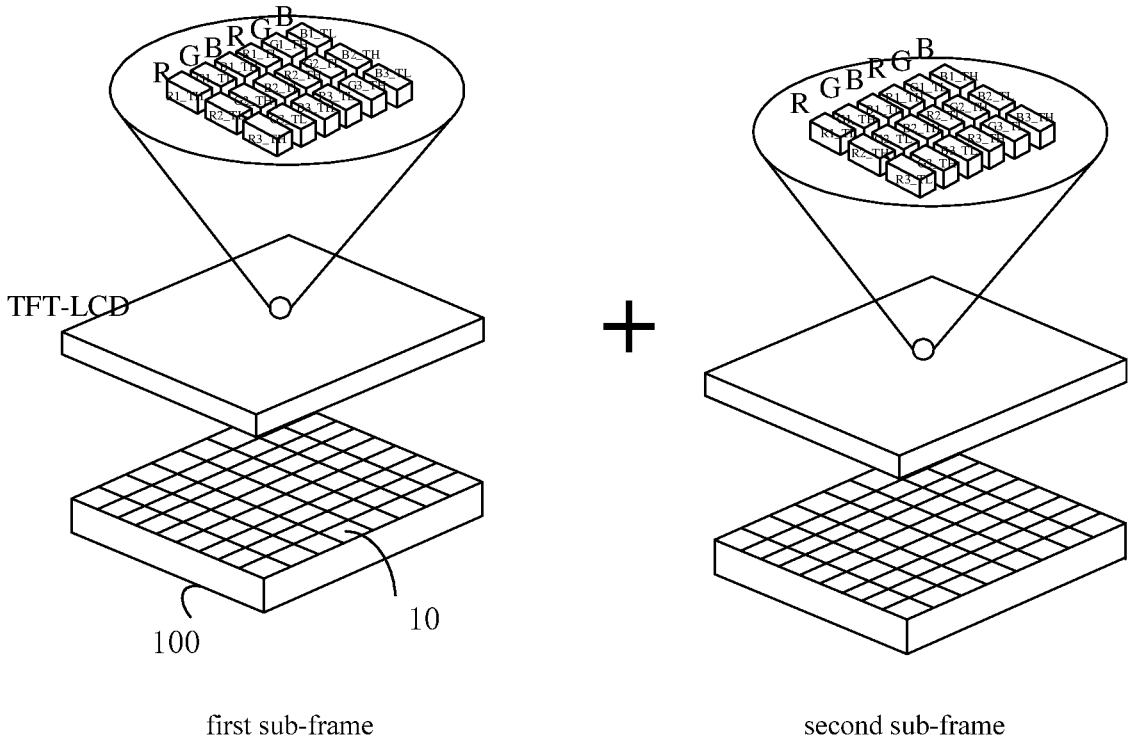
FIG. 3 is a schematic diagram of driving the display device in FIG. 2.
Figure 4:
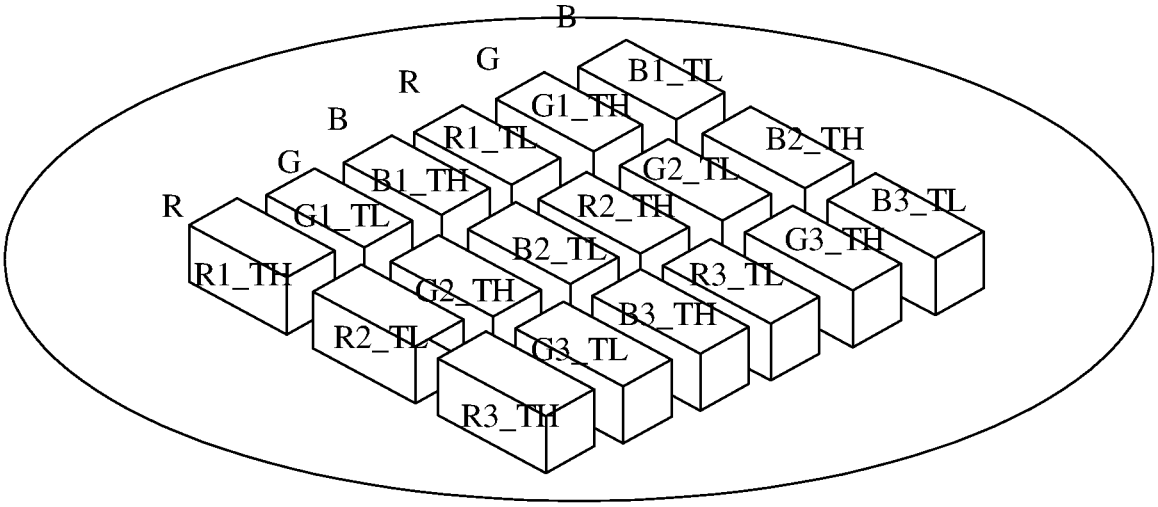
FIG. 4 is a partially enlarged view of FIG. 3.
Figures 5, 6:
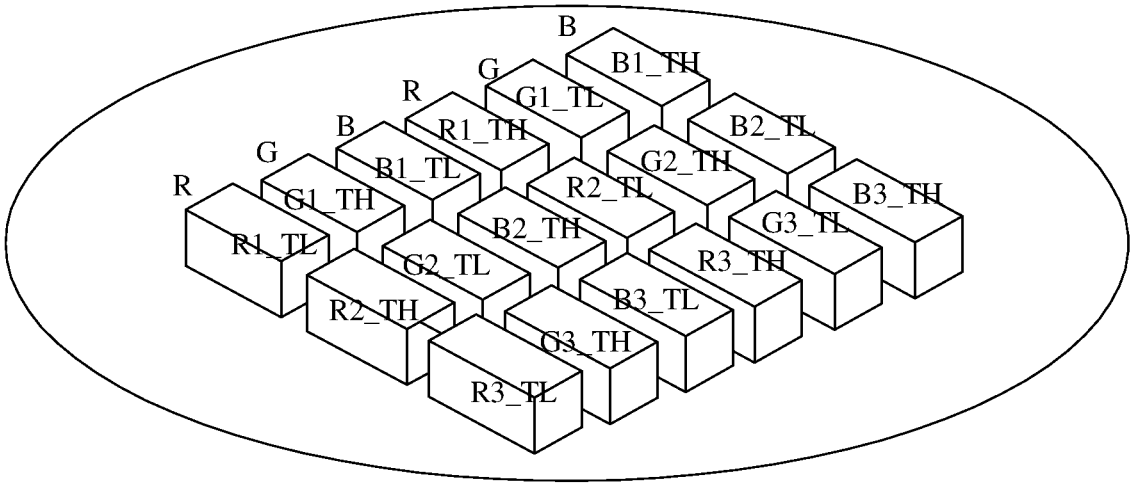
FIG. 5 is another partially enlarged view of FIG. 3.
FIG. 6 is a schematic diagram of performing spatial low-pass smoothing filtering processing on a backlight brightness compensation value in an embodiment.

According to the driving method for a display device in this embodiment, although each frame of image is displayed by two sub-frames, namely a front sub-frame and a rear sub-frame, it is not displayed by adopting a manner of two frames with a high driving voltage and a low driving voltage described in step S110. In this embodiment, each frame of image is similarly segmented into two frames of images, which are respectively marked as a first sub-frame and a second sub-frame, driving voltages of two adjacent sub-pixels in each block in each sub-frame are respectively a high voltage and a low voltage, and the driving voltage of each sub-pixel in the two sub-frames are respectively a high voltage and a low voltage. That is, the driving voltage of each sub-pixel of the first sub-frame is reversed to form the driving voltage of each sub-pixel of the second sub-frame. Like step S110, the driving voltage of each sub-pixel of the first sub-frame and the second sub-frame may be sought and obtained via a Look Up Table (LUT). Therefore, the high voltage signal and the low voltage signal corresponding to the driving voltage may be sought according to the color gray value of each sub-pixel in the input signal, so as to drive the corresponding sub-pixel in the first sub-frame by using the high voltage signal, and drive the corresponding sub-pixel in the second sub-frame by using the low voltage signal, or drive the corresponding sub-pixel in the first sub-frame by using the low voltage signal, and drive the corresponding sub-pixel in the second sub-frame by using the high voltage signal. Two adjacent sub-pixels are driven by adopting a driving manner with high and low driving voltages alternately, as shown in FIG. 3, in FIG. 3, the pixel on the display panel is amplified. FIG. 4 is a partially enlarged view of the first sub-frame in FIG. 3, and FIG. 5 is a partially enlarged view of the second sub-frame in FIG. 3. In the embodiment shown in FIG. 3, the driving voltages of any two adjacent sub-pixels in each block are respectively a high voltage and a low voltage.

S130, determine the amplitude of the backlight brightness compensation signals of two sub-frames according to the average driving voltage of the sub-pixel of each color in each region.

Two backlight brightness compensation signals of the backlight source of each color in each region 10 are respectively configured to perform backlight brightness adjustment on one sub-frame, so as to reduce the color cast of the view angle of the picture. For the pixel containing RGB three colors, the average driving voltage of red, green and blue sub-pixels in each sub-frame in one region 10 are respectively determined. The higher the average driving voltage of the sub-pixel of each color of each sub-frame in one region 10 is, the weaker the backlight brightness compensation signal of the sub-frame is, so as to alleviate the brightness difference of each region 10 between two sub-frames.

S140, adjust the emergent light brightness of the light source of each color in each region according to the backlight brightness compensation signal.

According to the driving method for a display device, each frame of image is displayed by a front sub-frame and a rear sub-frame, each frame of image is driven by adopting high and low voltage signals alternately, furthermore, high and low driving voltages of a first frame of image and a second frame of image are reversed, and a backlight brightness adjustment signal of the next picture is generated according to the average driving voltage of sub-pixels of each color in each region, so as to alleviate brightness difference of a same pixel between two sub-frames, and further reduce the flickering phenomenon caused by fluctuation of the driving voltages of the two sub-frames. The regional control unit divides the backlight circuit into a plurality of regions capable of independently controlling emergent light brightness, and correspondingly can perform independent backlight brightness compensation on pixels of different blocks on the display panel, and thus has a better anti-flickering effect in comparison with a backlight circuit adopting a uniform backlight brightness. Furthermore, by adopting the driving method for a display device, the pixel of the liquid crystal display does not need to be divided into main sub-pixel and secondary sub-pixel, and therefore, the process complexity of the display panel is greatly reduced, the penetration rate and the resolution of the liquid crystal display panel are greatly promoted, and the cost of backlight design is reduced.

In one embodiment, step S140 is to perform backlight brightness compensation on the next frame of image, that is, the backlight brightness of the currently displayed frame image is calculated according to the previous frame of image. Because two adjacent frames of images are basically the same, backlight brightness compensation for the current frame according to the previous frame of image is reasonable.

In one embodiment, step S130 is implemented according to the following manner.

Calculate the driving voltage average value $P_{M_ave1}$ (P represents the sub-pixel of the target color, M represents the serial number of the region 10 in the backlight circuit 100) of the sub-pixels of all target colors in each region 10 in the first sub-frame, the driving voltage average value $P_{M_ave2}$ in the second sub-frame, the driving voltage average value $P_{M_ave_H}$ of the high voltage signal of the frame of image and the driving voltage average value $P_{M_ave_L}$ of the low voltage signal, and calculate the backlight brightness compensation signal $A_{M_P1}$ of the first sub-frame and the backlight brightness compensation signal $A_{M_P2}$ of the second sub-frame according to $P_{M_ave1}$, $P_{M_ave2}$, $P_{M_ave_H}$, $P_{M_ave_L}$ and the reference backlight brightness signal $A_{M_P}$. The constraint conditions of the calculation are as follows: after the emergent light brightness of the region M is adjusted according to $A_{M_P1}$ and $A_{M_P2}$, the brightness of two sub-frames in the region M tends to be consistent; and the sum of the brightness of the two sub-frames in the region M tends to be consistent to the sum of the sub-frame brightness (the first frame described in step S110) obtained according to $A_{M_P}$ and $P_{M_ave_H}$ and the sub-frame brightness (the second frame described in step S110) obtained according to $A_{M_P}$ and $P_{M_ave_L}$. In this embodiment, the sub-pixels of the target color are respectively a red sub-pixel, a green sub-pixel and a blue sub-pixel, that is, calculation of the parameters needs to be respectively performed on the red sub-pixel, the green sub-pixel and the blue sub-pixel. Specifically, calculation is performed according to the following formulae.

For the red sub-pixel:

$$A_{M_R}*R_{M_ave_H}+A_{M_R}*R_{M_ave_L}=A_{M_R1}*R_{M_ave1}+A_{M_R2}*R_{M_ave2};$$

$$A_{M_R1}*R_{M_ave1}=A_{M_R2}*R_{M_ave2};$$

where M represents a serial number of the region 10, $A_{M_R}$ represents the brightness value of the reference backlight brightness signal of the red light source, $A_{M_R1}$ represents the brightness value of the backlight brightness compensation signal of the red light source of the first sub-frame in two corresponding sub-frames in the region M, $A_{M_R2}$ represents the brightness value of the backlight brightness compensation signal of the red light source of the second sub-frame in the two corresponding sub-frames in the region M, $R_{M_ave1}$ represents the average value of the driving voltage of the red sub-pixel of the first sub-frame in the region M, $R_{M_ave2}$ represents the average value of the driving voltage of the red sub-pixel of the second sub-frame in the region M, $R_{M_ave_H}$ represents the average value of the driving voltage of the red sub-pixel of the sub-frame corresponding to the high voltage signal in the region M, and $R_{M_ave_L}$ represents the average value of the driving voltage of the red sub-pixel of the sub-frame corresponding to the low voltage signal in the region M.

For the green sub-pixel:

$$A_{M_G}*G_{M_ave_H}+A_{M_G}*G_{M_ave_L}=A_{M_G1}*G_{M_ave1}+A_{M_G2}*G_{M_ave2};$$

$$A_{M_G1}*G_{M_ave1}=A_{M_G2}*G_{M_ave2};$$

where M represents a serial number of the region 10, $A_{M_G}$ represents the brightness value of the reference backlight brightness signal of the green light source, $A_{M_G1}$ represents the brightness value of the backlight brightness compensation signal of the green light source of the first sub-frame in two corresponding sub-frames in the region M, $A_{M_G2}$ represents the brightness value of the backlight brightness compensation signal of the green light source of the second sub-frame in the two corresponding sub-frames in the region M, $G_{M_ave1}$ represents the average value of the driving voltage of the green sub-pixel of the first sub-frame in the region M, $G_{M_ave2}$ represents the average value of the driving voltage of the green sub-pixel of the second sub-frame in the region M, $G_{M_ave_H}$ represents the average value of the driving voltage of the green sub-pixel of the sub-frame corresponding to the high voltage signal in the region M, and $G_{M_ave_L}$ represents the average value of the driving voltage of the green sub-pixel of the sub-frame corresponding to the low voltage signal in the region M.

For the blue sub-pixel:

$$A_{M_B}*B_{M_ave_H}+A_{M_B}*B_{M_ave_L}=A_{M_B1}*B_{M_ave1}+A_{M_B2}*B_{M_ave2};$$

$$A_{M_B1}*B_{M_ave1}=A_{M_B2}*B_{M_ave2};$$

where M represents a serial number of the region 10, $A_{M_B}$ represents the brightness value of the reference backlight brightness signal of the blue light source, $A_{M_B1}$ represents the brightness value of the backlight brightness compensation signal of the blue light source of the first sub-frame in two corresponding sub-frames in the region M, $A_{M_B2}$ represents the brightness value of the backlight brightness compensation signal of the blue light source of the second sub-frame in the two corresponding sub-frames in the region M, $B_{M_ave1}$ represents the average value of the driving voltage of the blue sub-pixel of the first sub-frame in the region M, $B_{M_ave2}$ represents the average value of the driving voltage of the blue sub-pixel of the second sub-frame in the region M, $B_{M_ave_H}$ represents the average value of the driving voltage of the blue sub-pixel of the sub-frame corresponding to the high voltage signal in the region M, and $B_{M_ave_L}$ represents the average value of the driving voltage of the blue sub-pixel of the sub-frame corresponding to the low voltage signal in the region M.

In this embodiment, because the driving voltage of the sub-pixel is matched with the input signal (that is, the gray value of the corresponding color), the average value of the driving voltage may be used as an evaluation parameter for the brightness of the view angle of the sub-pixel of the color.

It may be understood that because the backlight circuit includes a plurality of regions 10 capable of independently control emergent light brightness, and independent backlight brightness compensation is performed on different blocks on the display panel, difference may exist between emergent light brightness of the regions 10, while due to the emergent light brightness difference between adjacent regions, the phenomenon of non-uniform brightness may be observed by naked eyes. In order to solve or alleviate the defect, in one embodiment, before the step S140, the method further includes a step of adjusting the backlight brightness compensation signal of each region 10, so as to alleviate the emergent light brightness difference between adjacent regions. Further, in one embodiment, the adjustment is implemented by spatial low-pass smoothing filtering processing. After spatial low-pass smoothing filtering processing, the difference between the backlight brightness compensation values of each region 10 will not be too great, so as to avoid the phenomena of non-uniform brightness and flickering caused by great difference of emergent light brightness.

Spatial low-pass smoothing filtering processing is equivalent to evaluation of the emergent light brightness of other regions around each region of the backlight circuit, and then the backlight brightness compensation value of the region is adjusted accordingly. It may be understood that because two sub-frames of one frame of image respectively correspond to one backlight brightness compensation signal, spatial low-pass smoothing filtering processing needs to be performed on these two backlight brightness compensation signals respectively (the processing principles of the two signals are the same). By taking the backlight circuit 200 of the 9*7=63 regions as shown in FIG. 6 as an example, explanation is made to the spatial low-pass smoothing filtering processing of the backlight brightness compensation signal corresponding to the first sub-frame: assuming that the backlight brightness compensation value, calculated in the step S130, of the region marked with f(x,y) in the diagram is f(x,y), with x, y respectively representing horizontal coordinate and vertical coordinate, because each region includes an RGB three-color light source, f(x,y) is relevant to the backlight brightness compensation signals $A_{M_R1}$, $A_{M_G1}$ and $A_{M_B1}$ of the three-color light source, and during spatial low-pass smoothing filtering processing, three colors are processed respectively (that is, calculation is performed on $f(x,y)=A_{M_R1}$, $f(x,y)=A_{M_G1}$, $f(x,y)=A_{M_B1}$ respectively). Since eight regions are adjacent to the region (already marked in FIG. 6), backlight brightness compensation value obtained by spatial low-pass smoothing filtering processing in the region is $g(x,y)=w1*f(x-1,y-1)+w2*f(x-1,y)+w3*f(x-1,y+1)+w4*f(x,y-1)+w5*f(x,y)+w6*f(x,y+1)+w7*f(x+1,y-1)+w8*f(x+1,y)+w9*f(x+1,y+1)$. w1-w9 are weights of the regions, and the specific value of the weights may be designed by persons skilled in the art themselves by experiment and experience. Generally, w1+w2+ . . . +w9=1. It may be understood that three adjacent regions exist for the regions located at four corners of the backlight circuit 200; and five adjacent regions exist for the regions located beside the backlight circuit 200. It may be understood that spatial low-pass smoothing filtering processing needs to be performed on the backlight brightness compensation signals $P_{M_ave1}$ and $P_{M_ave2}$ respectively corresponding to two sub-frames respectively.

This application further provides a display device, including a display panel, a backlight circuit and a driving circuit. The display device may be liquid crystal displays of TN (twisted nematic), VA (vertical alignment), OCB (optical compensated bend) and other types, but it is not limited thereto. Downright or broadside backlight may be applied as backlight of the liquid crystal display, the backlight source is an RGB three-color backlight source, and the display device may also be a liquid crystal display with a curved screen.

In one embodiment, the backlight circuit includes a backlight source and a regional control unit. The backlight source is an RGB three-color backlight source, the backlight source is divided into a plurality of regions by the regional control unit, each region includes three light sources including a red light source, a green light source, and a blue light source, and the emergent light brightness of each light source in each region is independently controlled. Pixels of the display panel are divided into blocks in one-to-one correspondence to the regions of the backlight circuit. The driving circuit is configured to execute the driving method for a display device, and the method may be implemented in match with software stored in a memory of the driving circuit, that is, the method is implemented by the match of software and hardware, and may also be implemented by adopting pure hardware circuits known in the art.

Figure 7:
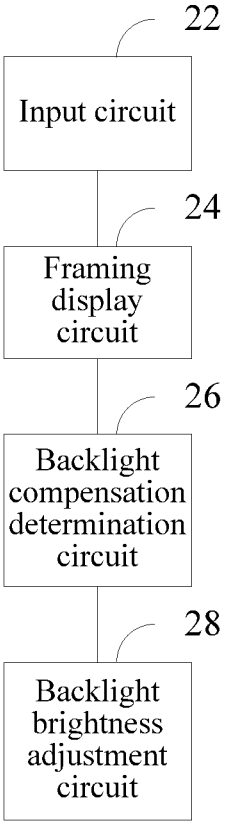
FIG. 7 is a structural block diagram of a driving circuit in an embodiment.

Referring to FIG. 7, in this embodiment, the driving circuit includes an input circuit 22, a framing display circuit 24, a backlight compensation determination circuit 26, and a backlight brightness adjustment circuit 28. The input circuit 22 is configured to acquire the input signal of each frame of image to be displayed, and acquire the high voltage signal and the low voltage signal of the driving voltage of each sub-pixel of the display device. The framing display circuit 24 is configured to display each frame of image by a front sub-frame and a rear sub-frame according to the high voltage signal and the low voltage signal, where the driving voltages of each sub-frame to two adjacent sub-pixels in each of the blocks are respectively a high voltage and a low voltage, and the driving voltages of each sub-pixel in the two sub-frames are respectively a high voltage and a low voltage. The backlight compensation determination circuit 26 is configured to count on the driving voltage average value $P_{M_ave1}$ (P represents the sub-pixel of the target color, M represents the serial number of the region 10 in the backlight circuit 100) of the sub-pixels of all target colors in each region 10 in the first sub-frame, the driving voltage average value $P_{M_ave2}$ in the second sub-frame, the driving voltage average value $P_{M_ave_H}$ of the high voltage signal of the frame of image and the driving voltage average value $P_{M_ave_L}$ of the low voltage signal, and calculate the backlight brightness compensation signal $A_{M_P1}$ of the first sub-frame and the backlight brightness compensation signal $A_{M_P2}$ of the second sub frame according to $P_{M_ave1}$, $P_{M_ave2}$, $P_{M_ave_H}$, $P_{M_ave_L}$ and the reference backlight brightness signal $A_{M_P}$. The constraint conditions of the calculation are as follows: after the emergent light brightness of the region M is adjusted according to $A_{M_P1}$ and $A_{M_P2}$, the brightness of two sub-frames in the region M tends to be consistent; and the sum of the brightness of the two sub-frames in the region M tends to be consistent to the sum of the sub-frame brightness (the first frame described in step S110) obtained according to $A_{M_P}$ and $P_{M_ave_H}$ and the sub-frame brightness (the second frame described in step S110) obtained according to $A_{M_P}$ and $P_{M_ave_L}$. In this embodiment, the sub-pixels of the target color are respectively a red sub-pixel, a green sub-pixel and a blue sub-pixel, that is, calculation of the parameters needs to be respectively performed on the red sub-pixel, the green sub-pixel, and the blue sub-pixel. Specifically, calculation is performed according to the following formulae.

For the red sub-pixel:

$$A_{M_R}*R_{M_ave_H}A_{M_R}*R_{M_ave_L}=A_{M_R1}*R_{M_ave1}+A_{M_R2}*R_{M_ave2};$$

$$A_{M_R1}*R_{M_ave1}=A_{M_R2}*R_{M_ave2};$$

where M represents a serial number of the region 10, $A_{M_R}$ represents the brightness value of the reference backlight brightness signal of the red light source, $A_{M_R1}$ represents the brightness value of the backlight brightness compensation signal of the red light source of the first sub-frame in two corresponding sub-frames in the region M, $A_{M_R2}$ represents the brightness value of the backlight brightness compensation signal of the red light source of the second sub-frame in the two corresponding sub-frames in the region M, $R_{M_ave1}$ represents the average value of the driving voltage of the red sub-pixel of the first sub-frame in the region M, $R_{M_ave2}$ represents the average value of the driving voltage of the red sub-pixel of the second sub-frame in the region M, $R_{M_ave_H}$ represents the average value of the driving voltage of the red sub-pixel of the sub-frame corresponding to the high voltage signal in the region M, and $R_{M_ave_L}$ represents the average value of the driving voltage of the red sub-pixel of the sub-frame corresponding to the low voltage signal in the region M.

For the green sub-pixel:

$$A_{M_G}*G_{M_ave_H}+A_{M_G}*G_{M_ave_L}=A_{M_G1}*G_{M_ave1}+A_{M_G2}*G_{M_ave2};$$

$$A_{M_G1}*G_{M_ave1}=A_{M_G2}*G_{M_ave2};$$

where M represents a serial number of the region 10, $A_{M_G}$ represents the brightness value of the reference backlight brightness signal of the green light source, $A_{M_G1}$ represents the brightness value of the backlight brightness compensation signal of the green light source of the first sub-frame in two corresponding sub-frames in the region M, $A_{M_G2}$ represents the brightness value of the backlight brightness compensation signal of the green light source of the second sub-frame in the two corresponding sub-frames in the region M, $G_{M_ave1}$ represents the average value of the driving voltage of the green sub-pixel of the first sub-frame in the region M, $G_{M_ave2}$ represents the average value of the driving voltage of the green sub-pixel of the second sub-frame in the region M, $G_{M_ave_H}$ represents the average value of the driving voltage of the green sub-pixel of the sub-frame corresponding to the high voltage signal in the region M, and $G_{M_ave_L}$ represents the average value of the driving voltage of the green sub-pixel of the sub-frame corresponding to the low voltage signal in the region M.

For the blue sub-pixel:

$$A_{M_B}*B_{M_ave_H}+A_{M_B}*B_{M_ave_L}=A_{M_B1}*B_{M_ave1}+A_{M_B2}*B_{M_ave2};$$

$$A_{M_B1}*B_{M_ave1}=A_{M_B2}*B_{M_ave2};$$

where M represents a serial number of the region 10, $A_{M_B}$ represents the brightness value of the reference backlight brightness signal of the blue light source, $A_{M_B1}$ represents the brightness value of the backlight brightness compensation signal of the blue light source of the first sub-frame in two corresponding sub-frames in the region M, $A_{M_B2}$ represents the brightness value of the backlight brightness compensation signal of the blue light source of the second sub-frame in the two corresponding sub-frames in the region M, $B_{M_ave1}$ represents the average value of the driving voltage of the blue sub-pixel of the first sub-frame in the region M, $B_{M_ave2}$ represents the average value of the driving voltage of the blue sub-pixel of the second sub-frame in the region M, $B_{M_ave_H}$ represents the average value of the driving voltage of the blue sub-pixel of the sub-frame corresponding to the high voltage signal in the region M, and $B_{M_ave_L}$ represents the average value of the driving voltage of the blue sub-pixel of the sub-frame corresponding to the low voltage signal in the region M.

This application further provides a display device, including a display panel, a backlight circuit, and a driving chip. The display device may be liquid crystal displays of TN, VA, OCB and other types, but it is not limited thereto. Downright or broadside backlight may be applied as backlight of the liquid crystal display, the backlight source is an RGB three-color backlight source, and the display device may also be a liquid crystal display with a curved screen.

In one embodiment, the backlight circuit includes a backlight source and a regional control unit. The backlight source is an RGB three-color backlight source, the backlight source is divided into a plurality of regions by the regional control unit, each region includes three light sources including a red light source, a green light source, and a blue light source, and the emergent light brightness of each light source in each region is independently controlled. Pixels of the display panel are divided into blocks in one-to-one correspondence to the regions of the backlight circuit. The driving chip is configured to executing the driving method for a display device, and the method may be implemented in match with software stored in a memory of the driving chip, that is, the method is implemented by the match of software and hardware.

The foregoing embodiments only describe several implementations of this application, which are described specifically and in detail, and therefore cannot be construed as a limitation to the patent scope of this application. It should be noted that, a person of ordinary skill in the art may make various changes and improvements without departing from the ideas of this application, which shall all fall within the protection scope of this application. Therefore, the patent protection scope of this application should be subject to the appended claims.

What is claimed is:

1. A driving method for a display device, comprising:

dividing a red-green-blue three-color backlight source of a display device into a plurality of regions, pixels of the display device being divided into blocks in one-to-one correspondence to the plurality of regions of the backlight source;

independently controlling an emergent light brightness of a light source of each color in each region of the plurality of regions with regional control device;

acquiring an input signal of each image frame to be displayed, and a high voltage signal and a low voltage signal of a driving voltage of each sub-pixel of the display device;

displaying each image frame by a front sub-frame and a rear sub-frame according to the high voltage signal and the low voltage signal, driving voltages of two adjacent sub-pixels in each of the blocks for each sub-frame are respectively a high voltage and a low voltage, and the driving voltages of each sub-pixel in the two sub-frames are respectively a high voltage and a low voltage;

determining amplitude of backlight brightness compensation signals of the light source of each color in each of the plurality of regions respectively corresponding to the two sub-frames according to an average driving voltage of the sub-pixel of each color in each of the plurality of regions; the higher the average driving voltage is, the weaker the backlight brightness compensation signal is, and the lower the average driving voltage is, the stronger the backlight brightness compensation signal is, so as to alleviate a brightness difference of each of the regions between the two sub-frames;

adjusting the backlight brightness compensation signal of each region of the plurality of regions so as to alleviate the emergent light brightness difference between adjacent regions of the plurality of regions, wherein adjusting the backlight brightness compensation signal of each region of the plurality of regions is implemented by spatial low-pass smoothing filtering processing, and three colors are processed respectively during spatial low-pass smoothing filtering processing; and after adjusting the backlight brightness compensation signal, adjusting the emergent light brightness of the light source of each color in each region of the plurality of regions according to the backlight brightness compensation signal.

2. The method according to claim 1, further comprising acquiring a reference backlight brightness signal of the light source of each color corresponding to each image frame.

3. The method according to claim 2, wherein the determining the amplitude of backlight brightness compensation signals of the light source of each color in each of the plurality of regions respectively corresponding to the two sub-frames according to the average driving voltage of the sub-pixel of each color in each of the plurality of regions comprises:

calculating a driving voltage average value of the sub-pixel of each color in each of the plurality of regions in one sub-frame, a driving voltage average value in another sub-frame, a driving voltage average value of the high voltage signal and a driving voltage average value of the low voltage signal, and calculating the backlight brightness compensation signal accordingly based on the driving voltage average values and the reference backlight brightness signal, wherein constraint conditions of the calculation are as follows: brightness of the two sub-frames in each region of the plurality of regions tends to be consistent after the emergent light brightness of the light source of each color in each region of the plurality of regions is adjusted according to the backlight brightness compensation signals; and a sum of the brightness of the two sub-frames in each region of the plurality of regions tends to be consistent to a sum of sub-frame brightness obtained according to the reference backlight brightness signal and the high voltage signal and a sub-frame brightness obtained according to the reference backlight brightness signal and the low voltage signal.

4. The method according to claim 3, wherein the calculation is according to the following formulae:

for a red sub-pixel:

$$A_{M_R}*R_{M_ave_H}+A_{M_R}*R_{M_ave_L}=A_{M_R1}*R_{M_ave1}+A_{M_R2}*R_{M_ave2};$$

$$A_{M_R1}*R_{M_ave1}=A_{M_R2}*R_{M_ave2};$$

wherein M represents a serial number of the region, $A_{M_R}$ represents a brightness value of the reference backlight brightness signal of a red light source, $A_{M_R1}$ represents the brightness value of the backlight brightness compensation signal of the red light source of a first sub-frame in two corresponding sub-frames in the region M, $A_{M_R2}$ represents a brightness value of the backlight brightness compensation signal of the red light source of a second sub-frame in the two corresponding sub-frames in the region M, $R_{M_ave1}$ represents the average value of the driving voltage of the red sub-pixel of the first sub-frame in the region M, $R_{M_ave2}$ represents the average value of the driving voltage of the red sub-pixel of the second sub-frame in the region M, $R_{M_ave_H}$ represents the average value of the driving voltage of the red sub-pixel of the sub-frame corresponding to the high voltage signal in the region M, and $R_{M_ave_L}$ represents the average value of the driving voltage of the red sub-pixel of the sub-frame corresponding to the low voltage signal in the region M;

for a green sub-pixel:

$$A_{M_G}*G_{M_ave_H}+A_{M_G}*G_{M_ave_L}=A_{M_G1}*G_{M_ave1}+A_{M_G2}*G_{M_ave2};$$

$$A_{M_G1}*G_{M_ave1}=A_{M_G2}*G_{M_ave2};$$

wherein M represents a serial number of the region, $A_{M_G}$ represents a brightness value of the reference backlight brightness signal of a green light source, $A_{M_G1}$ represents a brightness value of the backlight brightness compensation signal of the green light source of a first sub-frame in two corresponding sub-frames in the region M, $A_{M_G2}$ represents a brightness value of the backlight brightness compensation signal of the green light source of a second sub-frame in the two corresponding sub-frames in the region M, $G_{M_ave1}$ represents the average value of the driving voltage of the green sub-pixel of the first sub-frame in the region M, $G_{M_ave2}$ represents the average value of the driving voltage of the green sub-pixel of the second sub-frame in the region M, $G_{M_ave_H}$ represents an average value of the driving voltage of the green sub-pixel of the sub-frame corresponding to the high voltage signal in the region M, and $G_{M_ave_L}$ represents an average value of the driving voltage of the green sub-pixel of the sub-frame corresponding to the low voltage signal in the region M; and for a blue sub-pixel:

$$A_{M_B}*B_{M_ave_H}+A_{M_B}*B_{M_ave_L}=A_{M_B1}*B_{M_ave1}+A_{M_B2}*B_{M_ave2};$$

$$A_{M_B1}*B_{M_ave1}=A_{M_B2}*B_{M_ave2};$$

wherein M represents a serial number of the region, $A_{M_B}$ represents a brightness value of the reference backlight brightness signal of a blue light source, $A_{M_B1}$ represents a brightness value of the backlight brightness compensation signal of the blue light source of a first sub-frame in two corresponding sub-frames in the region M, $A_{M_B2}$ represents the brightness value of the backlight brightness compensation signal of the blue light source of a second sub-frame in the two corresponding sub-frames in the region M, $B_{M_ave1}$ represents an average value of the driving voltage of the blue sub-pixel of the first sub-frame in the region M, $B_{M_ave2}$ represents an average value of the driving voltage of the blue sub-pixel of the second sub-frame in the region M, $B_{M_ave_H}$ represents an average value of the driving voltage of the blue sub-pixel of the sub-frame corresponding to the high voltage signal in the region M, and $B_{M_ave_L}$ represents an average value of the driving voltage of the blue sub-pixel of the sub-frame corresponding to the low voltage signal in the region M.

5. The method according to claim 1, wherein the adjusting the emergent light brightness of the light source of each color in each region of the plurality of regions according to the backlight brightness compensation signal is to perform backlight brightness compensation to a next image frame.

6. A display device, comprising:

a display panel;

a backlight circuit, comprising a backlight source and regional control device, wherein the backlight source is a red-green-blue three-color backlight source, the regional control device is configured to divide the backlight source into a plurality of regions; each region of the plurality of regions comprises three light sources including a red light source, a green light source, and a blue light source; the regional control device is further configured to independently control the emergent light brightness of each light source in each region of the plurality of regions, and pixels of the display panel are divided into blocks in one-to-one correspondence to the plurality of regions of the backlight circuit; and a driving circuit, comprising:

an input circuit, configured to acquire an input signal of each image frame to be displayed, and acquire a high voltage signal and a low voltage signal of a driving voltage of each sub-pixel of the display device;

a framing display circuit, configured to display each image frame by a front sub-frame and a rear sub-frame according to the high voltage signal and the low voltage signal, the driving voltages of each sub-frame to two adjacent sub-pixels in each of the blocks are respectively a high voltage and a low voltage, and the driving voltages of each sub-pixel in the two sub-frames are respectively a high voltage and a low voltage;

a backlight compensation determination circuit, configured to determine amplitude of backlight brightness compensation signals of the light source of each color in each of the plurality of regions respectively corresponding to the two sub-frames according to the average driving voltage of the sub-pixel of each color in each of the plurality of regions; the higher the average driving voltage is, the weaker the backlight brightness compensation signal is, and the lower the average driving voltage is, the stronger the backlight brightness compensation signal is, so as to alleviate the brightness difference of each of the plurality of regions between the two sub-frames;

a backlight brightness adjustment circuit, configured to adjust the emergent light brightness of the light source of each color in each region of the plurality of regions according to the backlight brightness compensation signal; and a spatial low-pass smoothing filter, configured to adjust the backlight brightness compensation signal of each of the plurality of regions, so as to alleviate the emergent light brightness of adjacent regions of the plurality of regions, wherein three colors are processed respectively during spatial low-pass smoothing filtering processing:

wherein the backlight brightness adjustment circuit adjusts the emergent light brightness of each region of the plurality of regions according to the backlight brightness compensation signal adjusted by the spatial low-pass smoothing filter.

7. The display device according to claim 6, wherein the driving circuit further comprises a reference backlight brightness circuit, configured to acquire a reference backlight brightness signal of the light source of each color corresponding to each image frame.

8. The display device according to claim 7, wherein the backlight compensation determination circuit comprises:

a first sub-frame statistic circuit, configured to count on an average value of driving voltage of the sub-pixel of each color in each of the plurality of regions in the first sub-frame of the two sub-frames;

a second sub-frame statistic circuit, configured to count on an average value of driving voltage of the sub-pixel of each color in each of the plurality of regions in the second sub-frame of the two sub-frames;

a high voltage statistics circuit, configured to count on an average value of the driving voltage of a high voltage signal of the sub-pixel of each color in each of the plurality of regions;

a low voltage statistics circuit, configured to count on an average value of the driving voltage of a low voltage signal of the sub-pixel of each color in each of the plurality of regions; and a calculation circuit, configured to calculate the backlight brightness compensation signal according to values obtained by statistics of the first sub-frame statistic circuit, the second sub-frame statistic circuit, the high voltage statistics circuit and the low voltage statistics circuit and the reference backlight brightness signal, and constraint conditions of the calculation are as follows: the brightness of the two sub-frames in each region of the plurality of regions tends to be consistent after the emergent light brightness of the light source of each color in each region of the plurality of regions is adjusted according to the backlight brightness compensation signal; and a sum of the brightness of the two sub-frames in each region of the plurality of regions tends to be consistent to the sum of a sub-frame brightness obtained according to the reference backlight brightness signal and the high voltage signal and a sub-frame brightness obtained according to the reference backlight brightness signal and the low voltage signal.

9. The display device according to claim 6, wherein adjusting by the backlight brightness adjustment circuit the emergent light brightness of the light source of each color in each region of the plurality of regions according to the backlight brightness compensation signal is to perform backlight brightness compensation to a next image frame.

10. A display device, comprising:

a display panel;

a backlight circuit, comprising a backlight source and regional control device, the backlight source is a red-green-blue three-color backlight source, the regional control device is configured to divide the backlight source into a plurality of regions; each region of the plurality of regions comprises three light sources including a red light source, a green light source, and a blue light source; the regional control device is further configured to independently control an emergent light brightness of each light source in each region of the plurality of regions, and pixels in the display panel are divided into blocks in one-to-one correspondence to the plurality of regions of the backlight circuit; and a driving chip, storing instructions, wherein the following steps are executed when the instructions are executed by the driving chip:

acquiring an input signal of each image frame to be displayed, and acquiring a high voltage signal and a low voltage signal of a driving voltage of each sub-pixel of the display device;

displaying each image frame by a front sub-frame and a rear sub-frame according to the high voltage signal and the low voltage signal, driving voltages of two adjacent sub-pixels in each of the blocks in each sub-frame are respectively a high voltage and a low voltage, and the driving voltages of each sub-pixel in the two sub-frames are respectively a high voltage and a low voltage;

determining amplitude of backlight brightness compensation signals of the light source of each color in each of the plurality of regions respectively corresponding to the two sub-frames according to an average driving voltage of the sub-pixel of each color in each of the plurality of regions; the higher the average driving voltage is, the weaker the backlight brightness compensation signal is, and the lower the average driving voltage is, the stronger the backlight brightness compensation signal is, so as to alleviate the brightness difference of each of the plurality of regions between the two sub-frames;

adjusting the backlight brightness compensation signal of each region of the plurality of regions so as to alleviate the emergent light brightness difference between adjacent regions of the plurality of regions, wherein adjusting the backlight brightness compensation signal of each region of the plurality of regions is implemented by spatial low-pass smoothing filtering processing, and three colors are processed respectively during spatial low-pass smoothing filtering processing; and after adjusting the backlight compensation signal, adjusting the emergent light brightness of the light source of each color in each region of the plurality of regions according to the backlight brightness compensation signal.

11. The display device according to claim 10, wherein when the instruction is executed by the driving chip, the following steps is further implemented: acquiring a reference backlight brightness signal of the light source of each color corresponding to each image frame.

12. The display device according to claim 11, wherein the determining the amplitude of backlight brightness compensation signals of the light source of each color in each of the plurality of regions respectively corresponding to the two sub-frames according to the average driving voltage of the sub-pixel of each color in each of the plurality of regions further comprises:

counting on a driving voltage average value of the sub-pixel of each color in each of the plurality of regions in one sub-frame, a driving voltage average value in another sub-frame, a driving voltage average value of the high voltage signal and a driving voltage average value of the low voltage signal, and calculating the backlight brightness compensation signal accordingly based on the driving voltage average values and the reference backlight brightness signal, wherein constraint conditions of the calculation are as follows: the brightness of the two sub-frames in each region of the plurality of regions tends to be consistent after the emergent light brightness of the light source of each color in each region of the plurality of regions is adjusted according to the backlight brightness compensation signal; and a sum of the brightness of the two sub-frames in each region of the plurality of regions tends to be consistent to a sum of a sub-frame brightness obtained according to the reference backlight brightness signal and the high voltage signal and a sub-frame brightness obtained according to the reference backlight brightness signal and the low voltage signal.

13. The display device according to claim 12, wherein the calculation is executed according to the following formulae:

for a red sub-pixel:

$$A_{M_R}*R_{M_ave_H}+A_{M_R}*R_{M_ave_L}=A_{M_R1}*R_{M_ave1}+A_{M_R2}*R_{M_ave2};$$

$$A_{M_R1}*R_{M_ave1}=A_{M_R2}*R_{M_ave2};$$

wherein M represents a serial number of the region, $A_{M_R}$ represents a brightness value of the reference backlight brightness signal of the red light source, $A_{M_R1}$ represents a brightness value of the backlight brightness compensation signal of the red light source of the first sub-frame in two corresponding sub-frames in the region M, $A_{M_R2}$ represents a brightness value of the backlight brightness compensation signal of the red light source of the second sub-frame in the two corresponding sub-frames in the region M, $R_{M_ave1}$ represents an average value of the driving voltage of the red sub-pixel of the first sub-frame in the region M, $R_{M_ave2}$ represents an average value of the driving voltage of the red sub-pixel of the second sub-frame in the region M, $R_{M_ave_H}$ represents an average value of the driving voltage of the red sub-pixel of the sub-frame corresponding to the high voltage signal in the region M, and $R_{M_ave_L}$ represents an average value of the driving voltage of the red sub-pixel of the sub-frame corresponding to the low voltage signal in the region M;

for a green sub-pixel:

$$A_{M_G}*G_{M_ave_H}+A_{M_G}*G_{M_ave_L}=A_{M_G1}*G_{M_ave1}+A_{M_G2}*G_{M_ave2};$$

$$A_{M_G1}*G_{M_ave1}=A_{M_G2}*G_{M_ave2};$$

wherein M represents a serial number of the region, $A_{M_G}$ represents a brightness value of the reference backlight brightness signal of the green light source, $A_{M_G1}$ represents a brightness value of the backlight brightness compensation signal of the green light source of the first sub-frame in two corresponding sub-frames in the region M, $A_{M_G2}$ represents a brightness value of the backlight brightness compensation signal of the green light source of the second sub-frame in the two corresponding sub-frames in the region M, $G_{M_ave1}$ represents an average value of the driving voltage of the green sub-pixel of the first sub-frame in the region M, $G_{M_ave2}$ represents an average value of the driving voltage of the green sub-pixel of the second sub-frame in the region M, $G_{M_ave_H}$ represents an average value of the driving voltage of the green sub-pixel of the sub-frame corresponding to the high voltage signal in the region M, and $G_{M_ave_L}$ represents an average value of the driving voltage of the green sub-pixel of the sub-frame corresponding to the low voltage signal in the region M; and for a blue sub-pixel:

$$A_{M_B}*B_{M_ave_H}+A_{M_B}*B_{M_ave_L}=A_{M_B1}*B_{M_ave1}+A_{M_B2}*B_{M_ave2};$$

$$A_{M_B1}*B_{M_ave1}=A_{M_B2}*B_{M_ave2};$$

wherein M represents a serial number of the region, $A_{M_B}$ represents a brightness value of the reference backlight brightness signal of the blue light source, $A_{M_B1}$ represents a brightness value of the backlight brightness compensation signal of the blue light source of the first sub-frame in two corresponding sub-frames in the region M, $A_{M_B2}$ represents a brightness value of the backlight brightness compensation signal of the blue light source of the second sub-frame in the two corresponding sub-frames in the region M, $B_{M_ave1}$ represents an average value of the driving voltage of the blue sub-pixel of the first sub-frame in the region M, $B_{M_ave2}$ represents an average value of the driving voltage of the blue sub-pixel of the second sub-frame in the region M, $B_{M_ave_H}$ represents an average value of the driving voltage of the blue sub-pixel of the sub-frame corresponding to the high voltage signal in the region M, and $B_{M_ave_L}$ represents an average value of the driving voltage of the blue sub-pixel of the sub-frame corresponding to the low voltage signal in the region M.

14. The display device according to claim 10, wherein adjusting the emergent light brightness of the light source of each color in each region of the plurality of regions according to the backlight brightness compensation signal is to perform backlight brightness compensation to a next image frame.

15. The display device according to claim 10, wherein before adjusting the emergent light brightness of each region of the plurality of regions according to the backlight brightness compensation signal, the method further comprises adjusting the backlight brightness compensation signal of each region of the plurality of regions so as to alleviate the emergent light brightness difference between adjacent regions.

16. The display device according to claim 15, wherein adjusting the backlight brightness compensation signal of each region of the plurality of regions is implemented by spatial low-pass smoothing filtering processing.

* * * * *